United States Patent [19]

Ruben

[11] 4,095,300

[45] Jun. 20, 1978

[54] CONSTRUCTION OF A FITTED CORNER FOR A BEDCOVER

[75] Inventor: Sol Ruben, Brooklyn, N.Y.

[73] Assignee: Richard G. Rattner, Woodmere, N.Y. ; a part interest

[21] Appl. No.: 764,140

[22] Filed: Jan. 31, 1977

[51] Int. Cl.[2] ..... A47G 9/00

[52] U.S. Cl. ..... 5/334 R; 5/335

[58] Field of Search ..... 5/333, 334 R, 335; 112/262

[56] References Cited

U.S. PATENT DOCUMENTS

| | | | |
|---|---|---|---|
| 3,127,621 | 4/1964 | Gruber | 5/334 R |
| 3,381,320 | 5/1968 | Mott | 5/334 R |
| 3,694,832 | 10/1972 | Jamison | 5/334 C |
| 3,739,408 | 6/1973 | Pagels | 5/334 C |

*Primary Examiner*—Casmir A. Nunberg
*Attorney, Agent, or Firm*—Ladas, Parry, Von Gehr, Goldsmith & Deschamps

[57] ABSTRACT

A construction of a decorative fitted corner for a bedcover consisting of a first stitched connection joining the cover together along two lines, each extending normal to a different one of two mutually perpendicular edges of the cover, to a point adjacent the junction of these lines, and second and third stitched connections extending from the edges to a point adjacent the junction of the lines, the second and third stitched connections respectively joining the area of the bedcover bounded by the first stitched connection and said edges to the remainder of the bedcover symmetrically on either side of the first stitched connection.

4 Claims, 6 Drawing Figures

FIG. 1
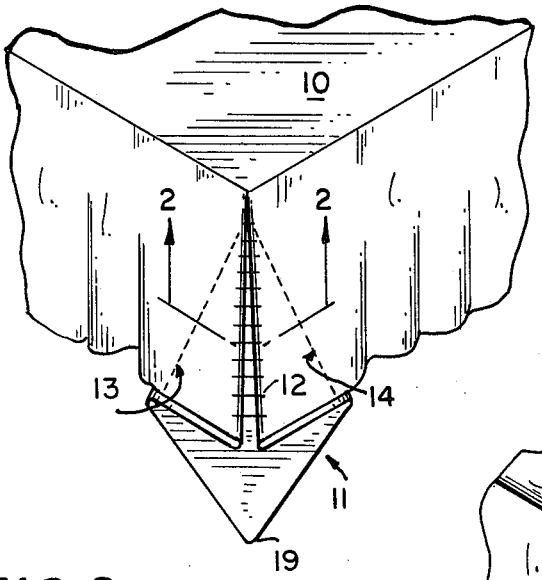
FIG. 4
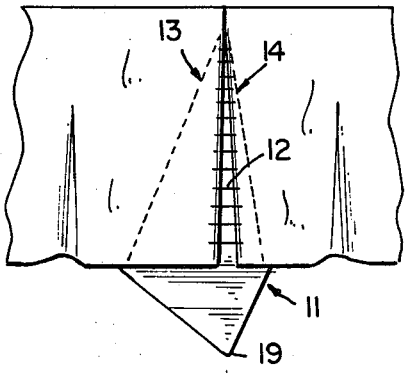
FIG. 2
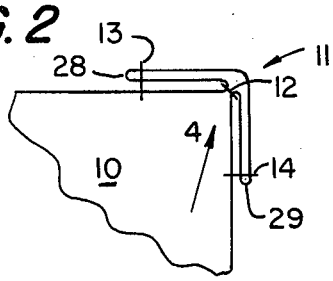
FIG. 5
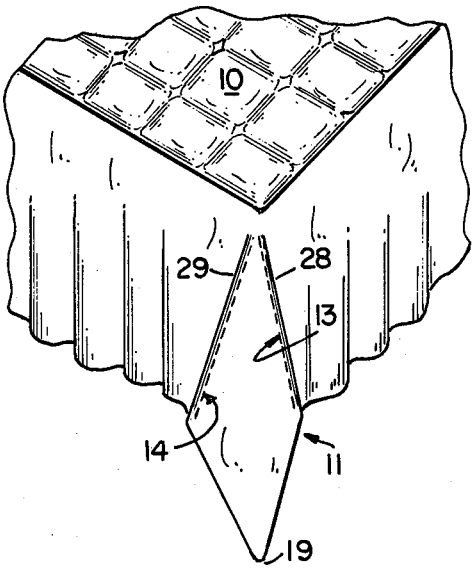
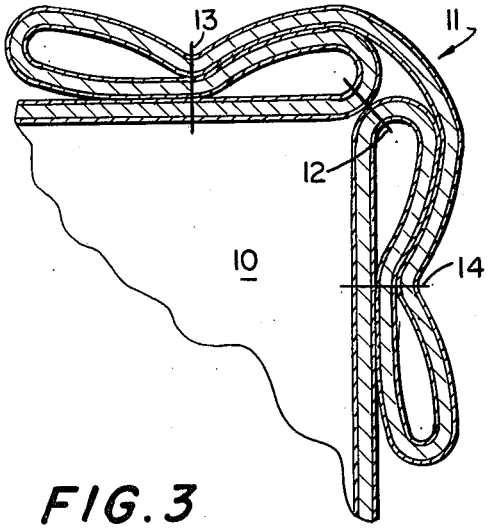
FIG. 3
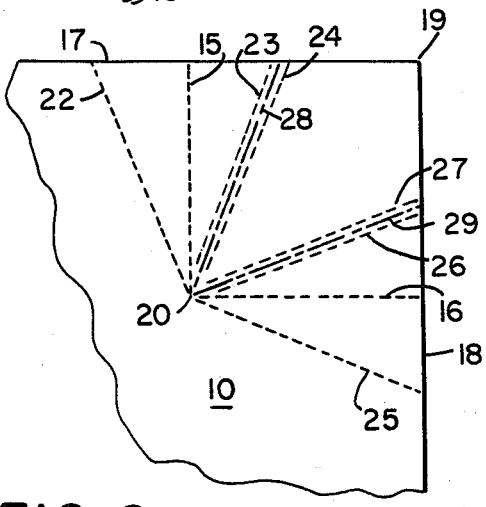
FIG. 6

CONSTRUCTION OF A FITTED CORNER FOR A BEDCOVER

This invention relates to a construction of a fitted corner for a bedcover.

As used in this specification and the appended claims a "fitted corner" means a formed or shaped corner arranged to fit over the sharp or generally rounded corner of a bed of generally square or rectangular plan which has substantially vertical sides and a "bedcover" means a bedspread or comforter constructed of synthetic or natural materials and includes such items whether constructed of a single layer of material or of a plurality of superimposed layers of material including, for example, quilted and filled constructions.

In the past the corners of bedcovers such as those which are the subject of the present invention have generally been allowed to hang freely and have not been constructed in fitted form to simulate the fall of a freely hanging corner.

It is an object of the present invention to provide a construction of a fitted corner of a bedcover which is economical to produce and decorative in appearance.

According to the present invention a construction of a fitted corner for a bedcover having two mutually perpendicular edges comprises a first stitched connection joining said fabric together along two lines, one extending from and substantially normal to each of said two edges to a point adjacent to the junction of said lines to define an area of said bedcover bounded by said edges and said two lines, and second and third stitched connections extending one from each said edge to a point adjacent the junction of said lines, said second and said third stitched connection respectively joining said area of said bedcover to the remainder of said bedcover symmetrically one on each side of said first stitched connection.

The present invention also provides a method of constructing a fitted corner of a bedcover having two mutually perpendicular edges which comprises stitching a first stitched connection to join said fabric together along two lines, one extending from and substantially normal to each of said two edges, to a point adjacent the junction of said lines thereby to define an area of said cover bounded by said edges and said two lines, and stitching second and third stitched connections extending one from each said edge to a point adjacent the junction of said lines, said second and said third stitched connections respectively joining said area of said bedcover to the remainder of said bedcover symmetrically one on each side of said first stitched connection.

The present invention will now be described, by way of example, with reference to the accompanying drawings in which:

FIG. 1 is a fragmentary perspective inside view of a corner constructed in accordance with the invention;

FIG. 2 is a fragmentary section along section line 2—2 of FIG. 1;

FIG. 3 is a fragmentary section similar to that shown in FIG. 2 illustrating an embodiment to the invention in which a cover is constructed of a relatively thick material.

FIG. 4 is a fragmentary view as seen along arrow 4 in FIG. 2.

FIG. 5 is a fragmentary perspective outside view of the corner shown in FIG. 1 and FIG. 6 is a view of a corner of a cover illustrating the fold and stitch lines prior to construction of a fitted corner such as that illustrated in FIG. 1.

FIGS. 1, 2, 4, 5 and 6 illustrate an embodiment of the invention in which the cover concerned is constructed from a relatively thin material while FIG. 3 illustrates an embodiment in which a relatively thick material is used, for example, a filled or quilted material. While there are minor differences between the construction involving a thin material and the construction involving a thick material, it will be appreciated that the concept of the present invention is generally applicable to both.

As illustrated in FIGS. 1, 2, 4, 5 and 6 a bedspread 10 constructed from a single layer of woven material includes a fitted corner 11 arranged to fit one of the corners of a mattress and boxspring at the foot of the bed. The bedspread 10 would also be constructed with a second such corner spaced from fitted corner 11 so that the bedspread will fit both corners of a mattress and boxspring at the foot of a bed. Each corner is constructed by the use of a first, second and third stitched connection (12, 13 and 14 respectively). The first stitched connection 12 joins the fabric of the cover together along lines 15 and 16 (see FIG. 6). Lines 15 and 16 extend respectively from mutually perpendicular edges 17 and 18 of the cover. In the embodiment illustrated lines 15 and 16 are disposed normal to edges 17 and 18 respectively and are equidistant from the junction 19 of edges 17 and 18. While lines 15 and 16 are shown as being normal to edges 17 and 18 in the embodiment described, it will be appreciated that variations from this normal orientation would fall within the inventive concept and may in some constructions be preferred. Accordingly, as used herein, reference to lines 15 and 16 as being normal to edges 17 and 18 respectively is to be taken to include arrangements in which lines 15 and 16 are disposed at any angle of 30° or less from the normal orientation described and, also, to include arrangements in which lines 15 and 16 are curved lines falling generally within the limitations of the angle referred to.

Lines 15 and 16 extend from edges 17 and 18 respectively to junction point 20 and the first stitched connection joins the material of the bedspread 10 together along lines 15 and 16 from edges 17 and 18 to a point adjacent the junction point 20 of lines 15 and 16.

Following the stitching of the first connection 12 the area of the cover bounded by lines 15, 16 and edges 17, 18 is folded to form a jabot or cravat shaped swallow tail with the material over said area disposed on the exterior 21 of the bedspread 10 (see FIG. 5). The jabot is symmetrically arranged about a line joining junction 19 and point 20 and is then stitched through the folded portion of the jabot and the remainder of the bedspread to form the second stitched connection 13 joining the fabric along lines 22, 23 and 24 together and to form the third stitched connection 14 joining the fabric together along lines 25, 26 and 27. Accordingly, the second and third stitched connections 13 and 14 involve stitching through three layers of the fabric. The lines 23 and 24 are disposed symmetrically on either side of and close to fold line 28 and the lines 26 and 27 are disposed symmetrically on either side of and close to fold line 29. Fold lines 28 and 29 are the folds which define the outer edges of the jabot (see FIG. 5). Junction 19 forms the lower hanging point of the jabot in the embodiment illustrated. It will be appreciated that this point may be rounded or cut in any desired way for decorative purposes or to prevent the jabot from hanging onto the floor.

In an embodiment utilizing thicker material such as might be used in a comforter the second and third stitched connections 13 and 14 may be disposed father from fold lines 28 and 29 in order to accommodate the thickness of the material and in order to provide a more curved free hanging appearance of the material of the jabot adjacent the area of the fold lines 28 and 29. This construction is particularly, though not exclusively, applicable to covers utilizing quilted constructions.

It will also be appreciated that in comforters of a design utilizing, for example, "Dacron" filling, the filling may be omitted from the area of the comforter forming the fitted corner in order to avoid an unduly bulkly construction.

I claim:

1. A construction of a fitted corner for a bedcover having two mutually perpendicular edges comprising a first stitched connection joining said fabric together along two lines, one extending from and substantially normal to each of said two edges, to a point adjacent to the junction of said lines to define an area of said bedcover bounded by said edges and said two lines, and second and third stitched connections extending one from each said edge to a point adjacent the junction of said lines, said second and said third stitched connection respectively joining said area of said bedcover to the remainder of said bedcover symmetrically one on each side of said first stitched connection.

2. A construction according to claim 1 wherein said symmetrical disposition of said area about said first stitched connection forms a jabot and said second and third stitched connections are closely adjacent the edges of said jabot.

3. A construction according to claim 1 wherein said symmetrical disposition of said area about said first stitched connection forms a jabot and said second and third stitched connections are spaced a sufficient distance from the edges of said jabot to facilitate construction from multilayer materials.

4. A construction according to claim 1 wherein said bedcover is constructed from a plurality of layers of material and at least one of these layers is omitted in the region of the bedcover used in the construction of said fitted corner.

* * * * *